US011060254B2

(12) United States Patent
Kirn

(10) Patent No.: US 11,060,254 B2
(45) Date of Patent: Jul. 13, 2021

(54) TOP-LOCKING BOLLARD

(71) Applicant: Columbia Cascade Company, Portland, OR (US)

(72) Inventor: Steven K. Kirn, Portland, OR (US)

(73) Assignee: COLUMBIA CASCADE COMPANY, Portland, OR (US)

( * ) Notice: Subject to any disclaimer, the term of this patent is extended or adjusted under 35 U.S.C. 154(b) by 0 days.

(21) Appl. No.: 16/676,226

(22) Filed: Nov. 6, 2019

(65) Prior Publication Data

US 2020/0224378 A1 Jul. 16, 2020

Related U.S. Application Data

(60) Provisional application No. 62/792,535, filed on Jan. 15, 2019.

(51) Int. Cl.
*E01F 13/00* (2006.01)
*E01F 13/02* (2006.01)

(52) U.S. Cl.
CPC ..... *E01F 13/026* (2013.01)

(58) Field of Classification Search
CPC ..... E01F 13/024; E01F 13/026; E01F 9/677
See application file for complete search history.

(56) References Cited

U.S. PATENT DOCUMENTS 1,875,878 A * 9/1932 McCaughley ..... E01F 9/615 40/607.04
2,859,840 A * 11/1958 Fantle ..... E04H 12/32 52/38
3,061,960 A * 11/1962 Dull ..... E01F 13/085 49/35
4,003,161 A * 1/1977 Collins ..... E01F 13/026 49/35
4,062,149 A * 12/1977 Collins ..... E01F 13/026 49/49

(Continued)

FOREIGN PATENT DOCUMENTS

DE 202018103878 U1 * 7/2018 ..... E01F 13/026
FR 3029544 A1 * 6/2016 ..... E01F 13/026

OTHER PUBLICATIONS

Tool Station "Heavy Duty Folding Parking Post" (2017) retrieved from the Internet on Oct. 18, 2019 at <https://www.toolstation.com/heavy-duty-folding-parking-post/p10361>; 3 pages.

(Continued)

*Primary Examiner* — Thomas B Will
*Assistant Examiner* — Katherine J Chu
(74) *Attorney, Agent, or Firm* — Schwabe Williamson & Wyatt, PC

(57) ABSTRACT

A lockable bollard to be anchored into the ground includes a substantially vertical post that is rectangular in cross section, with a base having a base fastening structure extending downwardly to be anchored into the ground to which the post is to be anchored. A control shaft extends substantially the entire length of the post, the control shaft having an operating handle adjacent a top end and having a lower engagement feature adjacent a bottom end designed to selectively engage the base when the shaft is in a predetermined position. A closure is disposed adjacent the top of the post to permit selective access to the operating handle.

10 Claims, 5 Drawing Sheets

(56) References Cited

U.S. PATENT DOCUMENTS 4,715,742 A * 12/1987 Dickinson ..... E01F 13/046 404/6
5,192,159 A * 3/1993 Higginson ..... E01F 13/046 403/109.7
5,481,828 A * 1/1996 Kentrotas ..... E01F 13/046 49/35
5,509,754 A * 4/1996 Conigliaro ..... E01F 13/048 404/9
5,651,534 A * 7/1997 Yoder ..... E04H 12/2215 256/66
5,711,110 A * 1/1998 Williams ..... E01F 13/085 49/25
6,409,419 B1 * 6/2002 Hernandez ..... E01F 13/04 404/6
7,331,734 B1 * 2/2008 Gallop ..... E01F 13/08 404/11
7,472,891 B2 * 1/2009 Schram ..... E05B 53/00 256/65.14
7,481,599 B2 * 1/2009 Stice ..... E01F 13/046 404/6
7,722,285 B2 * 5/2010 Schram ..... E05B 53/00 404/6
7,889,505 B1 * 2/2011 Beard ..... H04R 1/025 361/730
8,087,846 B2 * 1/2012 Ringelberg ..... E01F 13/028 404/6
8,297,873 B1 * 10/2012 Schram ..... E01F 9/685 404/9
8,650,741 B1 * 2/2014 Piper ..... E06B 3/9641 29/525.01
2017/0175384 A1 * 6/2017 Bergman ..... E04F 11/1812
2019/0241349 A1 * 8/2019 Pearson ..... B65D 81/3813
2020/0263375 A1 * 8/2020 Hoe ..... E01F 13/026

OTHER PUBLICATIONS

Reliance Foundry "Removable Bollard" (2017) retrieved from the Internet on Oct. 18, 2019 at <https://www.reliance-foundry.com/bollard/all-bollards/r-8464-ra-bollard>; 10 pages.
TPS Group "Removable Bollards" (2017) retrieved from the Internet on Oct. 18, 2019 at <https://www.trafficparking.com.au/removable-bollards.php>; 11 pages.
Traffic Guard "Round Post Top Lock Bollards" (2017) retrieved from the Internet on Oct. 18, 2019 at <https://www.trafficguard.net/removable/locking/roundposttoplock/>; 6 pages.

* cited by examiner

TOP-LOCKING BOLLARD

CROSS-REFERENCE TO RELATED APPLICATION

This application claims priority to U.S. Provisional Application No. 62/792,535, filed Jan. 15, 2019, the entire disclosure of which is incorporated herein by reference.

FIELD OF THE INVENTION

The invention relates to a top-locking bollard.

BACKGROUND OF THE INVENTION

A bollard is a sturdy vertical post. The term originally referred to a post on a ship used principally for mooring boats, but is now also used to refer to posts installed to control road traffic. Bollards are typically round in cross section and are locked in place to prevent unauthorized removal. It is important, however, that authorized personnel have the ability to remove a bollard in the event that authorized vehicles, such as work trucks, are to be granted access. This controlled access is usually provided by a padlock. In order to render the bollard visually pleasing, the padlock is often disposed at the base of the bollard or even below ground level to be totally invisible to the casual eye.

A problem with bollards having locks disposed adjacent their base, either above or below ground level, is that they may become fouled by road debris. Worse yet, they are an attraction to dogs and other animals that may urinate on the very mechanism employees need to handle to gain access to the roadway being blocked by the bollard. This not only becomes troublesome to such a person but some such personnel may actually refuse to handle the lock system. This has become problematic to those using bollards since the ability to block and to allow access is critical. And yet the lock has until now needed to be positioned at the base of the bollard in order to access the base to which the bollard is locked.

The present disclosure provides a solution to the foregoing problem by providing a bollard that may be locked to a base with a lock that is disposed at an upper portion of the bollard. Positioning the lock at an elevated position facilitates easy locking and un-locking and avoids the prior art problems with the locks that are handled by the operators being fouled by dogs and road debris.

The disclosed embodiment includes a bollard post that may be rectangular in cross section, and normally would be a rectangle with equal sides; that is, square in cross section. It includes a base that is mounted in the road or path. The post includes a top plate or other closure adjacent the top end that may be locked in a closed position and unlocked to be opened when desired by authorized personnel. Typically, the top plate includes a slot that fits over a loop extending from the post so that a padlock may be placed in the loop to lock access to a control handle. Opening the closure provides access to a shaft having the control handle at the top and a lower engagement feature at the bottom. The shaft extends the length of the bollard post and permits the operator to control the rotatable position of the shaft. Operation of the control handle permits the operator to rotate the shaft, moving the lower engagement feature into and out of alignment with a base engagement feature. The control handle may be as simple as a flat, linear member and the lower engagement feature may be a simple 90 degree bend at the bottom that may be positioned in and out of alignment with the base engagement feature, which may take the form of a simple slot. However, other engagement shapes for the lower engagement feature and the base engagement feature may also be utilized as long as they complement each other.

SUMMARY OF THE INVENTION

A bollard is provided that includes a substantially vertical post that is irregular in cross section. A base has a base fastening structure extending downwardly to be anchored in the ground to which the post is to be positioned, the base including a base engagement feature. A control shaft extends substantially the entire length of the post, the control shaft having an operating handle adjacent a top end and having a lower engagement feature adjacent a bottom end designed to selectively engage the base when the shaft is in a predetermined rotational position. A closure is disposed adjacent the top of the post to permit selective access to the operating handle.

The post may be rectangular or even square in cross section. The closure may be a hinged plate that may be opened and closed. The post may include a loop and the plate includes a slot that permits the plate to be closed over the loop to facilitate the use of a padlock in the loop to selectively lock the plate in a closed position. The base engagement feature may be a slot and the lower engagement feature may be in the form of a complementing 90-degree bend in the shaft.

Another aspect of the invention provides a lockable bollard that is to be anchored into the ground. The bollard comprises: a substantially vertical post that is rectangular in cross section; a base having a base fastening structure extending downwardly to be anchored into the ground to which the post is to be anchored; a control shaft extending substantially the entire length of the post, the control shaft having an operating handle adjacent a top end and having a lower engagement feature adjacent a bottom end designed to selectively engage the base when the shaft is in a predetermined position; and a closure disposed adjacent the top of the post to permit selective access to the operating handle.

The control shaft may be rotatable, with the lower engagement feature selectively engaging the base, depending on the rotational disposition of the control shaft. The lower engagement feature may include a first configuration that selectively complements a second configuration in the base. Alternatively or additionally, the lower engagement feature may include a bend in the shaft and the second configuration may be in the form of a slot in the base.

DETAILED DESCRIPTION OF PREFERRED EMBODIMENT

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

Figure 1:
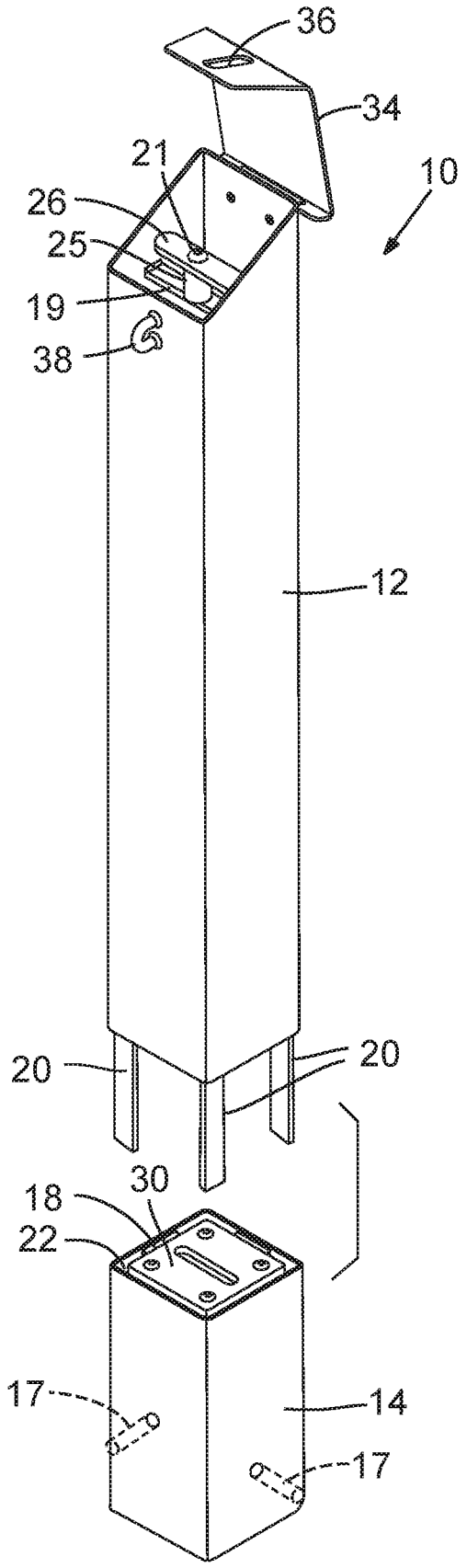
FIG. 1 is a perspective view of an embodiment showing the base and the post with the top plate open and the handle in an unlocked position.

The disclosed embodiment may be better understood by making reference to the figures. The depicted embodiment is identified at 10 and, as shown in FIG. 1, is comprised of a post 12 and a base 14. Both are shown to be square in cross section but they may be any multi-sided shape such as rectangular with uneven sides. Actually, any shape but round would work, as a round shape might permit the post to be turned in the base to allow unauthorized access. If a round shape is used, a simple system to prevent the post from rotating with respect to the base would normally be included. The foregoing shape will hereafter be described as "irregular," thus only limiting the shape to one that is not round in cross section. The term "rectangular" is used to encompass a figure with four straight sides and four right angles, with equal adjacent sides (as in a square) or unequal adjacent sides.

Figure 2:
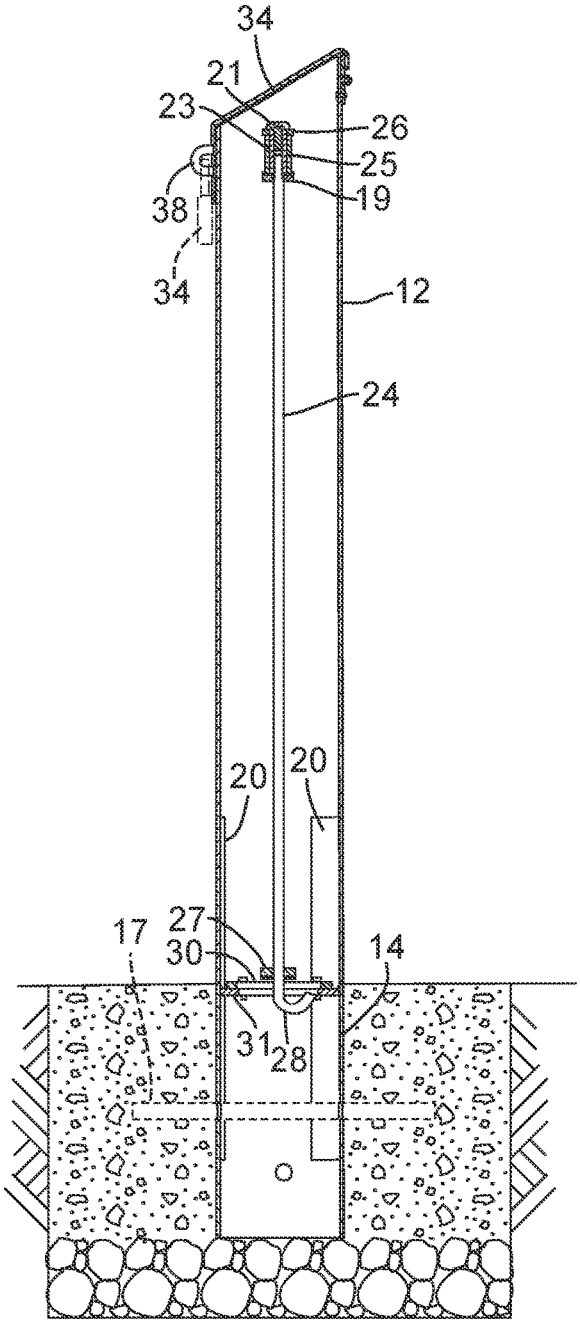
FIG. 2 is a side elevation sectional view of the embodiment of FIG. 1, with the base embedded in the ground and the top plate closed over the loop, with the handle in a locked position and showing a padlock in phantom.
Figure 3:
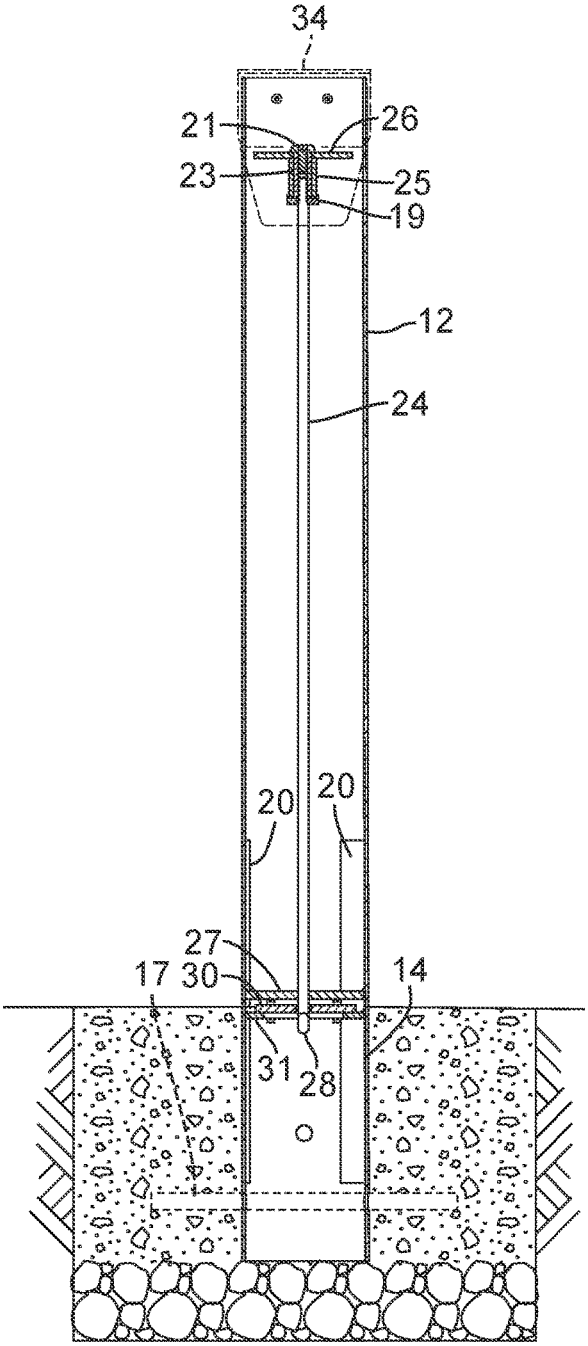
FIG. 3 is a front elevation sectional view corresponding to FIG. 2 except that the handle is in an unlocked position.

Base 14 is designed to be non-movably mounted in the ground such as in concrete 16, with a base top 18 being generally flush with the ground as shown in FIGS. 2 and 3. A pair of anchoring rods 17 may be used to affix the base in position and to prevent rotation in the concrete. In the depicted embodiment anchoring rods 17 are disposed at slightly different elevations. Post 12 typically has mounting rods 20 that extend downwardly into base 14 at apertures 22. The rods may be square, rectangular, angled or any other cross-sectional configuration.

Figure 4:
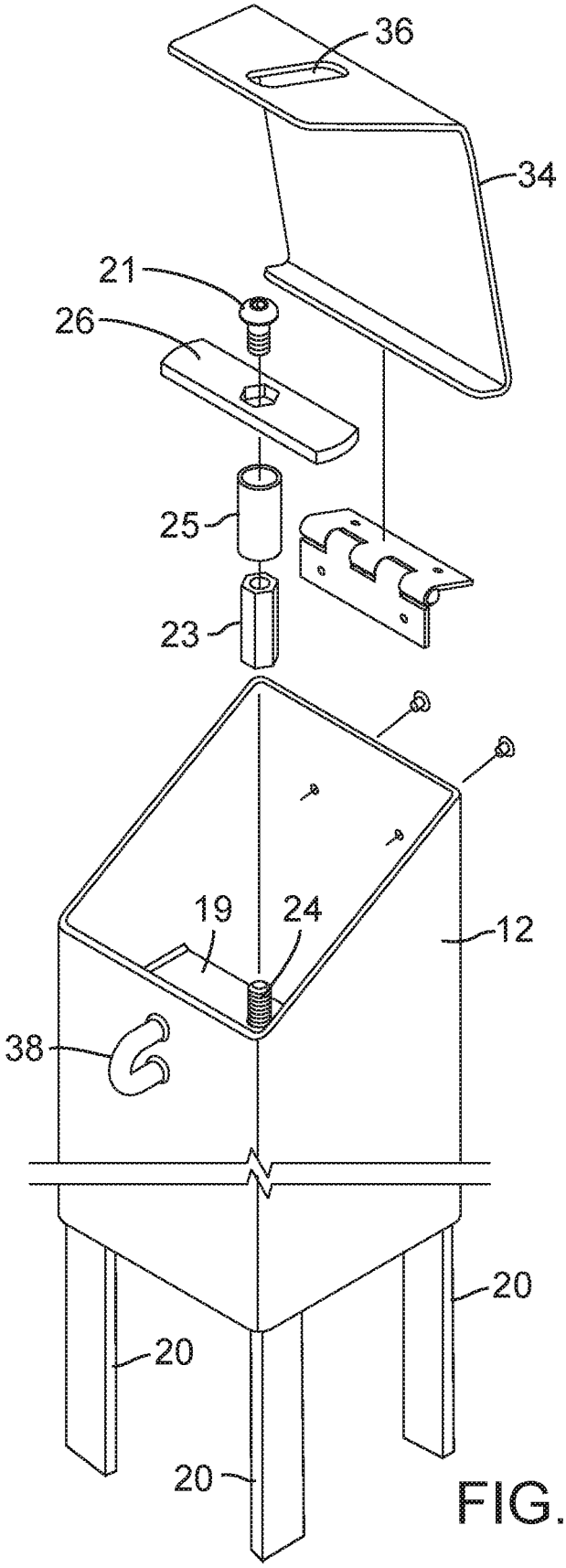
FIG. 4 is an exploded perspective view of a top portion of the depicted embodiment.
Figure 5:
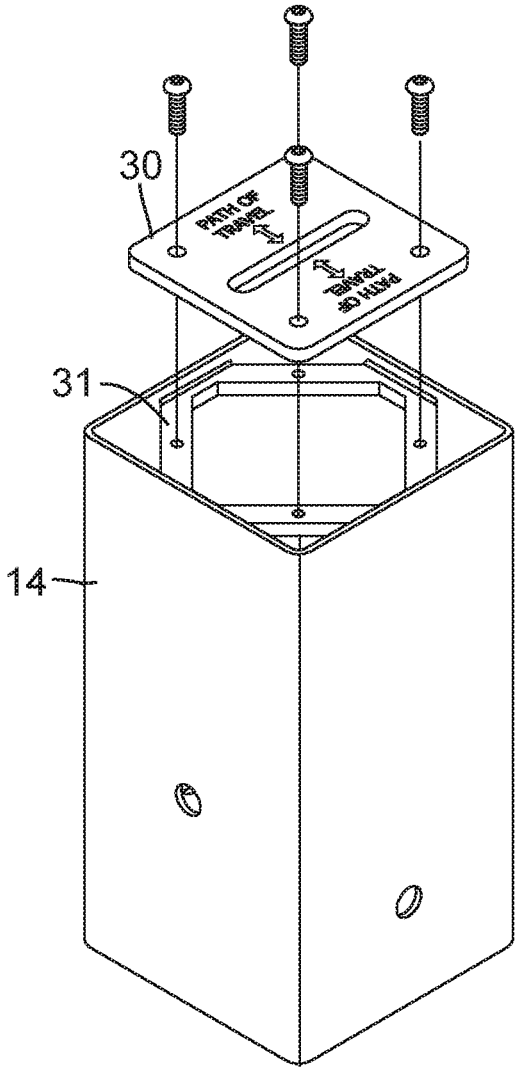
FIG. 5 is an exploded perspective view of a lower portion of the depicted embodiment.
Figure 6:
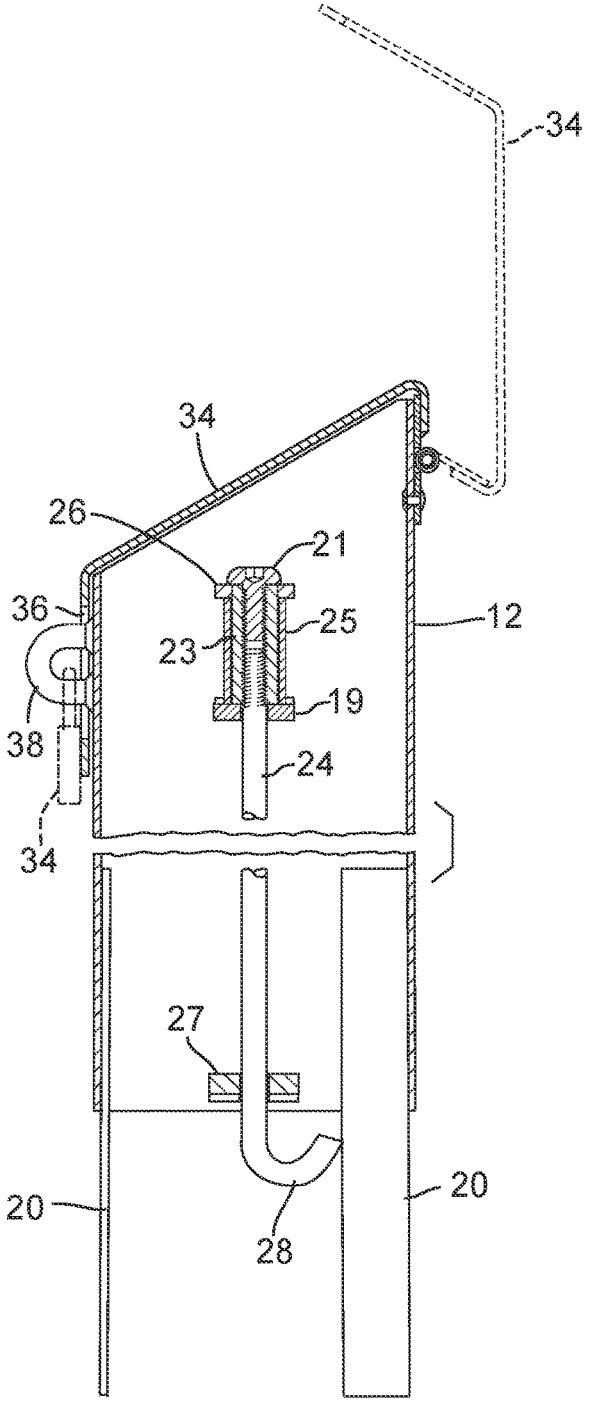
FIG. 6 is a side elevation sectional view of the upper and mid-portions of the depicted embodiment, with the handle in a locked position.
Figure 7:
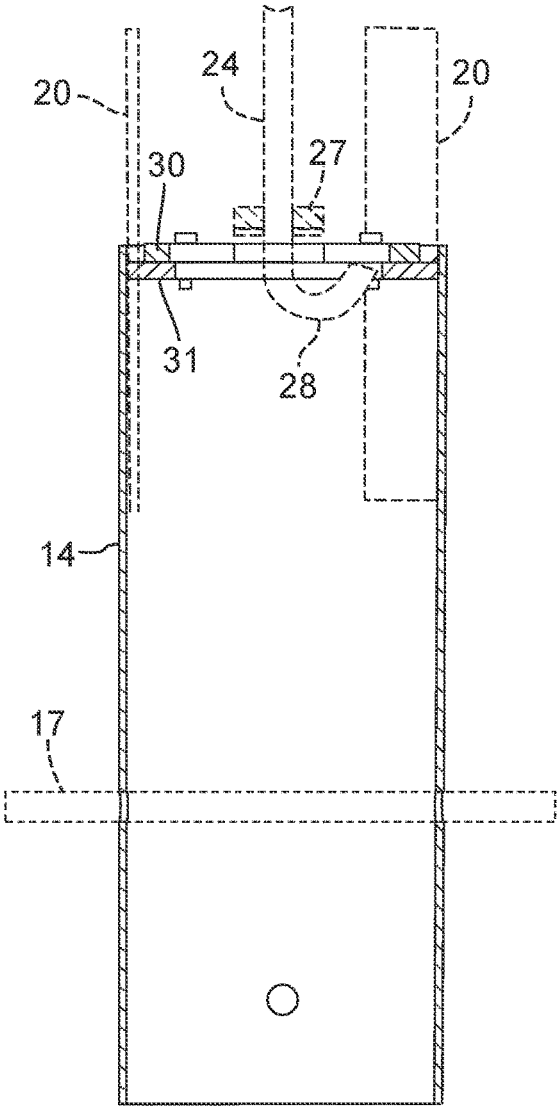
FIG. 7 is a side elevation sectional view of the lower portion of the depicted embodiment, with the lower end of the control shaft and mounting rods shown in phantom.
Figure 8:
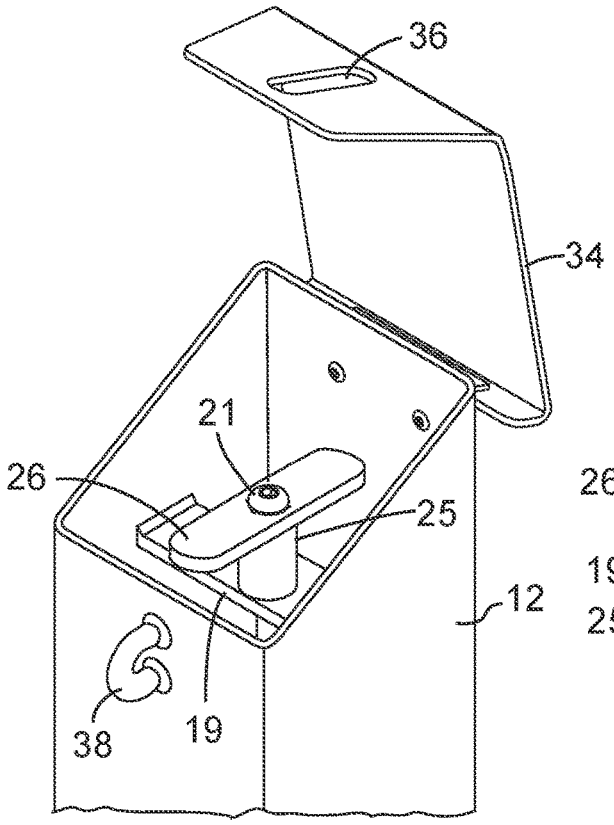
FIG. 8 is a perspective view of the top portion of the depicted embodiment with the handle in a locked position.
Figure 9:
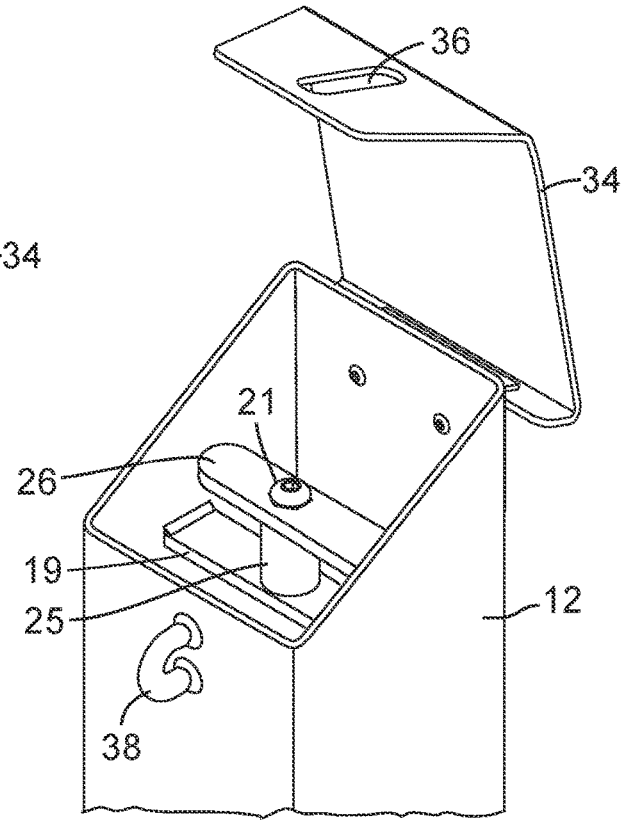
FIG. 9 is a perspective view of the top portion of the depicted embodiment with the handle in an unlocked locked position.
Figure 10:
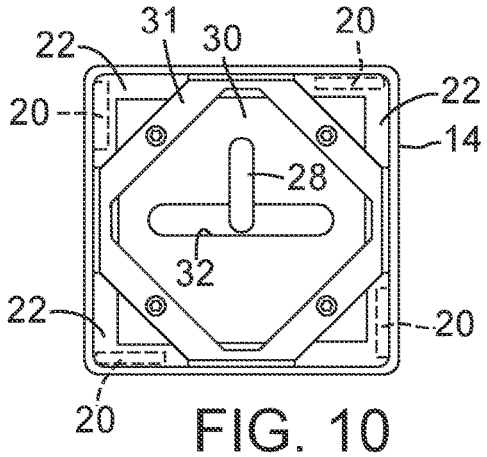
FIG. 10 is a top view of the lower engagement portion, showing the control shaft in a locked position.
Figure 11:
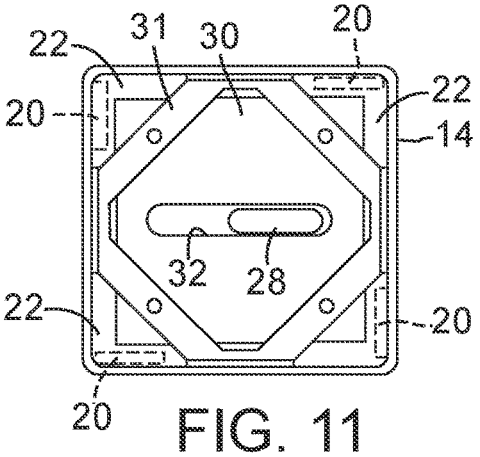
FIG. 11 is a top view of the lower engagement portion, showing the control shaft in a locked position.

A rigid shaft 24 extends through most of the length of post 12 and includes a handle 26 adjacent the top end to permit shaft 24 to be rotated. A stationary bar 19 may extend across post 12, through which shaft 24 extends. A similar stationary bar 27 may extend across a lower end of post 12, through which shaft 24 also extends. A bolt 21 may extend through an elongated threaded nut 23 within a sleeve 25 as shown best in FIG. 4. This depicted arrangement is not a necessary feature but facilitates some adjustability in the effective length of shaft 24.

In the depicted embodiment, the lower end of shaft 24 terminates in a lower engagement feature. In the depicted embodiment, this feature is in the form of a bent extension 28. In the depicted embodiment the bend is at 90 degrees although other lesser angles or configurations may be utilized. The engagement feature may alternatively include any configuration that selectively complements a second configuration in the base. Normally the control shaft is rotatable and the lower engagement feature selectively engages the base, depending on the rotational disposition of the control shaft.

Shaft 24 normally extends just past a base plate 30 that is mounted such as by bolts 29 to a mounting frame 31 that is securely mounted such as by welding to the inner periphery of base 14. Base plate 30 includes a base engagement feature that complements the configuration of the lower engagement feature of the shaft. In the depicted embodiment with the lower engagement feature taking the form of a 90 degree extension, the base engagement feature may take the form of a simple slot 32. A detent (not shown) may be provided as part of handle 26 so that the handle can easily be rotated by precisely the desired angle (typically 90 degrees) to align extension 28 with slot 32 when desired to unlock post 12 from base 14.

The upper end of post 12 includes a hinged top plate 34, which includes a top plate slot 36 designed to fit over a loop 38 affixed to the exterior of the post. With top plate 34 closed over the top of post 12, top plate slot 36 fits over loop 38, permitting the operator to place a padlock 39 (shown in phantom) or other locking member through the loop to control access to handle 26. An additional extension lip (not shown) may be provided in top plate 34 to extend over loop 38 and padlock 39 to protect the padlock from the elements.

To mount bollard 10 in place, base 14 is set in the ground and post 12 is slid into the base with mounting rods irons 20 extending into apertures 22. While mounting the post to the base, handle 26 should be used to adjust shaft 24 and 90 degree extension 28 to unlocked positions so that the extension can fit through slot 32 in base plate 30. Handle 26 can then be turned to lock the shaft to the base, which will securely lock post 12 to base 14. Top plate 34 is then closed over loop 38 and padlock 39 can be fitted into the loop, thus preventing unauthorized access to control handle 26.

With the bollard in this locked position, the access onto the roadway or path that is being blocked by the bollard will be prevented. In the event an authorized entry needs to be made, padlock 39 is unlocked, top plate 34 is opened, and handle 26 is accessed. To remove post 12 from base 14, handle 26 is rotated until extension 28 is aligned with slot 32 and the post may be lifted from base 14.

While the foregoing description and the accompanying drawings describe one embodiment of the present invention, variations may be made without departing from the scope of the invention. In any event, it is the following claims and not the foregoing detailed description, which sets forth the scope of this patent.

The invention claimed is:

1. A bollard comprising:

a substantially vertical post that is irregular in cross section, the post including a top, a bottom, and a plurality of downward extending spaced rods adjacent the bottom of the post;

a base extending no higher than ground level, the base to be anchored in the ground in which the post is to be positioned, the base including at least one downwardly extending aperture for removably receiving the spaced rods;

a control shaft extending substantially the entire length of the post, the control shaft having an operating handle adjacent a top end and having a lower engagement feature adjacent a bottom end designed to selectively engage the base when the shaft is in a predetermined rotational position; and a closure disposed adjacent the top of the post to permit selective access to the operating handle;

wherein the base includes a top end and an inner periphery, and the base further comprises a base plate disposed adjacent the top end of the base, with the at least one downwardly extending aperture at least partially defined between the inner periphery of the base and the base plate.

2. The bollard of claim 1 wherein the at last one downwardly extending aperature includes an upper end that is defined between the inner periphery of the base and the base plate.

3. A lockable bollard to be anchored into the ground below ground level, comprising:

a substantially vertical post that is rectangular in cross section, the post including top and bottom ends, sides and corners;

a base secured in the ground and extending no higher than ground level, the base having sides, corners, an upper end, and a central base plate disposed at the upper end of the base and defining at least one aperture between the base plate and the sides or corners of the base;

a plurality of spaced rods extending downwardly from the bottom end of the post adjacent the sides or corners thereof; and a control shaft extending substantially the entire length of the post, the control shaft having an operating handle adjacent a top end and having a lower engagement feature adjacent a bottom end designed to selectively engage the base when the shaft is in a predetermined position.

4. The bollard of claim 3 wherein the control shaft is rotatable and the lower engagement feature selectively engages the base, depending on the rotational disposition of the control shaft.

5. The bollard of claim 3 wherein the lower engagement feature includes a first configuration that selectively complements a second configuration in the base.

6. The bollard of claim 5 wherein the lower engagement feature comprises a bend in the shaft and the second configuration comprises a slot in the base.

7. The bollard of claim 6, further comprising a closure disposed adjacent the top end of the post to permit selective access to the operating handle.

8. The bollard of claim 3 wherein the base plate is mounted substantially flush with ground level.

9. The bollard of claim 3 wherein the position of the rods corresponds with that of the at least one aperture so that when the post and base are aligned, the rods can fit into the at least one aperture.

10. A bollard comprising:

a substantially vertical post that is irregular in cross section, the post including a top, a bottom, and a plurality of downward extending spaced rods adjacent the bottom of the post;

a base extending no higher than ground level, the base to be anchored in the ground in which the post is to be positioned, the base including at least one downwardly extending aperture for removably receiving the spaced rods;

a control shaft extending substantially the entire length of the post, the control shaft having an operating handle adjacent a top end and having a lower engagement feature adjacent a bottom end designed to selectively engage the base when the shaft is in a predetermined rotational position; and a closure disposed adjacent the top of the post to permit selective access to the operating handle;

wherein the at least one aperture is defined between the base and a centrally-disposed base plate.

* * * * *